US007545609B2

(12) United States Patent
Suzuki

(10) Patent No.: US 7,545,609 B2
(45) Date of Patent: Jun. 9, 2009

(54) DIRECT-CURRENT STABILIZED POWER SUPPLY DEVICE

(75) Inventor: Tomohiro Suzuki, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 306 days.

(21) Appl. No.: 11/445,157

(22) Filed: Jun. 2, 2006

(65) Prior Publication Data

US 2006/0273777 A1 Dec. 7, 2006

(30) Foreign Application Priority Data

Jun. 2, 2005 (JP) ..... 2005-162350

(51) Int. Cl.
*H02H 7/00* (2006.01)

(52) U.S. Cl. ..... 361/18; 361/58; 323/277

(58) Field of Classification Search ..... 323/282–288, 323/264, 266, 224, 226, 222; 327/535, 538, 327/581

See application file for complete search history.

(56) References Cited

U.S. PATENT DOCUMENTS 5,574,357 A * 11/1996 Otake et al. ..... 323/222
6,044,002 A 3/2000 Van Der Wal et al.
6,424,128 B1 * 7/2002 Hiraki et al. ..... 323/268
6,903,535 B2 * 6/2005 Liu et al. ..... 323/222
6,903,538 B2 * 6/2005 Umeda et al. ..... 323/268

FOREIGN PATENT DOCUMENTS

JP 2005-6442 A 1/2005

* cited by examiner

*Primary Examiner*—Rajnikant B Patel
(74) *Attorney, Agent, or Firm*—Birch, Stewart, Kolasch & Birch, LLP

(57) ABSTRACT

In a direct-current stabilized power supply device provided with an output transistor that receives an input voltage from the outside and a control circuit that controls the output transistor so that an output voltage of the direct-current stabilized power supply device is stabilized, there is provided a voltage supply circuit that steps down the input voltage and outputs the voltage thus obtained as a voltage for driving the control circuit. The voltage supply circuit is built as a charge pump circuit that steps down the input voltage and then outputs the voltage thus obtained.

10 Claims, 10 Drawing Sheets

DIRECT-CURRENT STABILIZED POWER SUPPLY DEVICE

This nonprovisional application claims priority under 35 U.S.C. § 119(a) on Patent Application No. 2005-162350 filed in Japan on Jun. 2, 2005, the entire contents of which are hereby incorporated by reference.

BACKGROUND OF THE INVENTION

1. Field of the Invention

The present invention relates to a direct-current stabilized power supply device that outputs a stabilized voltage.

2. Description of Related Art

Nowadays, direct-current stabilized power supply devices are widely used as power supply devices that can supply a stabilized voltage to a load regardless of variations in an input or a load or in surrounding environments. On the other hand, apparatuses that are provided with a digital circuit, such as computers or AV apparatuses, have been becoming increasingly popular in recent years, and such apparatuses are not able to function without a direct-current stabilized power supply device. Since these apparatuses are required to consume less energy for longer battery life and for less environmental impact, direct-current stabilized power supply devices with lower current consumption are sought after.

Used as the direct-current stabilized power supply device described above are a dropper-type stabilized power supply device that steps down an input voltage and then outputs it by using an output transistor as a type of variable resistance, and a chopper-type stabilized power supply device (a switching-type stabilized power supply device) that stabilizes an output voltage by controlling a duty ratio at which an output transistor is turned on/off.

Since the former dropper-type stabilized power supply device (the dropper regulator) stabilizes an output voltage by using the voltage drop across a transistor, it releases the voltage drop as heat. This makes the efficiency of this dropper-type stabilized power supply device not especially high when an input/output voltage difference is large. On the other hand, it offers ease of design and can find wide application because it suffers from less noise.

On the other hand, since the latter chopper-type stabilized power supply device (the chopper regulator) switches on/off an output transistor, thereby performing output control based on a duty ratio at which the output transistor is switched, it offers high efficiency when used in an application where an input/output voltage difference is large.

Incidentally, the stabilized power supply device has many functions such as overheat protection, overcurrent protection, and soft start, and has a built-in protection circuit for realizing the above described functions.

An example of a conventional dropper-type stabilized power supply device will be described with reference to FIG. 10. A conventional dropper-type stabilized power supply device 101 (hereinafter simply referred to as a "power supply device 101") is built with an output transistor 102, a control circuit 104, and a constant voltage circuit 131 that feeds a voltage for driving the control circuit 104. The control circuit 104 is composed of a reference voltage source 126 that outputs a reference voltage Vref, an error amplifier 125, a drive transistor 133, an overheating protection circuit 118, an overcurrent protection circuit 119, an OR circuit 120, and a transistor 134.

An input voltage Vin outputted from the direct current power source 5 is fed to the emitter of the output transistor 102 and to the constant voltage circuit 131. The output of the direct current power source 5 is grounded via a capacitor 6. An error between a voltage obtained by dividing an output voltage Vout of the power supply device 101 with voltage dividing resistances 7 and 8 and the reference voltage Vref is amplified by the error amplifier 125. The error amplifier 125 controls a base current of the output transistor 102 via the drive transistor 133, whereby the output voltage Vout is kept at a constant level. A load 10 operates from the output voltage Vout. A terminal from which the output voltage Vout is outputted is grounded via the capacitor 9.

When abnormal events occur, the built-in protection functions provide protection for the power supply device 101. For example, the overheating protection circuit 118 prevents the junction temperature of the output transistor 102 from exceeding a certain level due to, for example, an increase in internal heat resulting from a heavy load or an abnormal increase in the ambient temperature by forcing the output transistor 102 to be turned off when the junction temperature reaches a certain level. On the other hand, the overcurrent protection circuit 119 protects the power supply device 101 from overcurrent by limiting an output current so that a current above a certain level does not flow therethrough.

When overheat protection or overcurrent protection is made to operate, a high level signal is fed from the overheating protection circuit 118 or the overcurrent protection circuit 119 to the OR circuit 120. This turns on the transistor 134, and then the base voltage of the drive transistor 133 takes a low level (for example, 0.1 V). As a result, the base current of the output transistor 102 is interrupted, turning off the output of the power supply device 101.

The constant voltage circuit 131 is a circuit that stabilizes the input voltage Vin by using, for example, a constant voltage diode so as to deliver a relatively constant voltage to the control circuit 104 as a supply voltage thereof. Here, assume that the input voltage Vin is 12 V, the output voltage of the constant voltage circuit 131 (that is, the supply voltage of the control circuit 104) is 2.7 V, and current consumption of the control circuit 104 is 10 mA. Then, electric power consumed for driving the control circuit 104 is 12 V×10 mA=120 mW.

Moreover, a regulator is disclosed in JP-A-2005-6442 (hereinafter referred to as Patent Publication 1) that interrupts the supply of electric power to a protection circuit when protection such as overheat protection is not needed.

As described above, in the power supply device 101 of FIG. 10, a relatively large electric power is consumed for driving the control circuit 104. On the other hand, in the regulator of Patent Publication 1, since the supply of electric power to the protection circuit is interrupted when protection is not needed, it can be expected to reduce the electric power consumption. However, this does not sufficiently contribute to the reduction of electric power consumption, because electric power consumed by a control circuit other than the protection circuit is not reduced.

SUMMARY OF THE INVENTION

In view of the problems described above, it is an object of the present invention to provide a direct-current stabilized power supply device that can achieve a sufficient reduction of electric power consumed in the power supply device.

To achieve the above object, according to the present invention, in a direct-current stabilized power supply device provided with an output element that receives an input voltage from the outside and a control circuit that controls the output element so that an output voltage of the direct-current stabilized power supply device is stabilized, there is provided a voltage supply circuit that steps down the input voltage and outputs the voltage thus obtained as a voltage for driving the control circuit. The voltage supply circuit is built as a charge pump circuit that steps down the input voltage and then outputs the voltage thus obtained.

With this configuration, the input voltage is stepped down by the charge pump circuit and is then fed to the control circuit (if necessary, further via a constant voltage circuit, for example). This helps reduce electric power consumed in the power supply device for driving the control circuit.

For example, there is further provided an output current detection circuit that detects the magnitude of an output current of the direct-current stabilized power supply device. The voltage supply circuit varies the amount of suppliable current of the charge pump circuit depending on the detected magnitude of the output current.

For example, the output element is a bipolar transistor, the direct-current stabilized power supply device is further provided with a base current detection circuit that detects the magnitude of a base current of the bipolar transistor, and the voltage supply circuit varies the amount of suppliable current of the charge pump circuit depending on the detected magnitude of the base current.

For example, a load of the direct-current stabilized power supply device operates in a plurality of operating states of different electric power consumption, and the voltage supply circuit varies the amount of suppliable current of the charge pump circuit depending on an external signal indicating an operating state of the load.

This helps solve the shortage of current supply of the voltage supply circuit that can occur with an increase in the output current.

Specifically, for example, the charge pump circuit includes a plurality of switching elements connected in series, and a drive circuit that controls on/off of each of the plurality of switching elements. The charge pump circuit is configured so that the amount of suppliable current of the charge pump circuit increases with an increase in the ratio of the on-period of part of the plurality of switching elements to the sum of the on and off periods. The drive circuit varies the amount of suppliable current of the charge pump circuit by varying the ratio of the on-period of the part of the plurality of switching elements to the sum of the on and off periods.

Preferably, for example, there is provided an output current detection circuit that detects the magnitude of an output current of the direct-current stabilized power supply device, and, when the detected magnitude of the output current is found to be equal to or smaller than a predetermined first threshold value, the voltage supply circuit feeds the voltage obtained by stepping down the input voltage to a load of the direct-current stabilized power supply device, and the supply of voltage from the voltage supply circuit to the control circuit is interrupted.

Preferably, for example, the output element is a bipolar transistor, the direct-current stabilized power supply device is further provided with a base current detection circuit that detects the magnitude of a base current of the bipolar transistor, and, when the detected magnitude of the base current is found to be equal to or smaller than a predetermined second threshold value, the voltage supply circuit feeds the voltage obtained by stepping down the input voltage to a load of the direct-current stabilized power supply device, and the supply of voltage from the voltage supply circuit to the control circuit is interrupted.

Preferably, for example, operating states of a load of the direct-current stabilized power supply device include a first operating state and a second operating state in which electric power consumption is lower than that required in the first operating state, and, when an external signal indicating an operating state of the load indicates the second operating state, the voltage supply circuit feeds the voltage obtained by stepping down the input voltage to the load of the direct-current stabilized power supply device, and the supply of voltage from the voltage supply circuit to the control circuit is interrupted.

When the detected magnitude of the output current is equal to or smaller than the predetermined first threshold value, when the detected magnitude of the base current is equal to or smaller than the predetermined second threshold value, or when the external signal indicating the operating state of the load indicates the second operating state, the electric power consumption of the load is relatively low. In such cases, by making the voltage supply circuit feed electric power to the load and interrupt the supply of voltage to the control circuit, electric power consumed by the control circuit is reduced to zero. This helps further reduce electric power consumption.

For example, the direct-current stabilized power supply device is a chopper-type direct-current stabilized power supply device.

DETAILED DESCRIPTION OF PREFERRED EMBODIMENTS

First Embodiment

Figure 1:
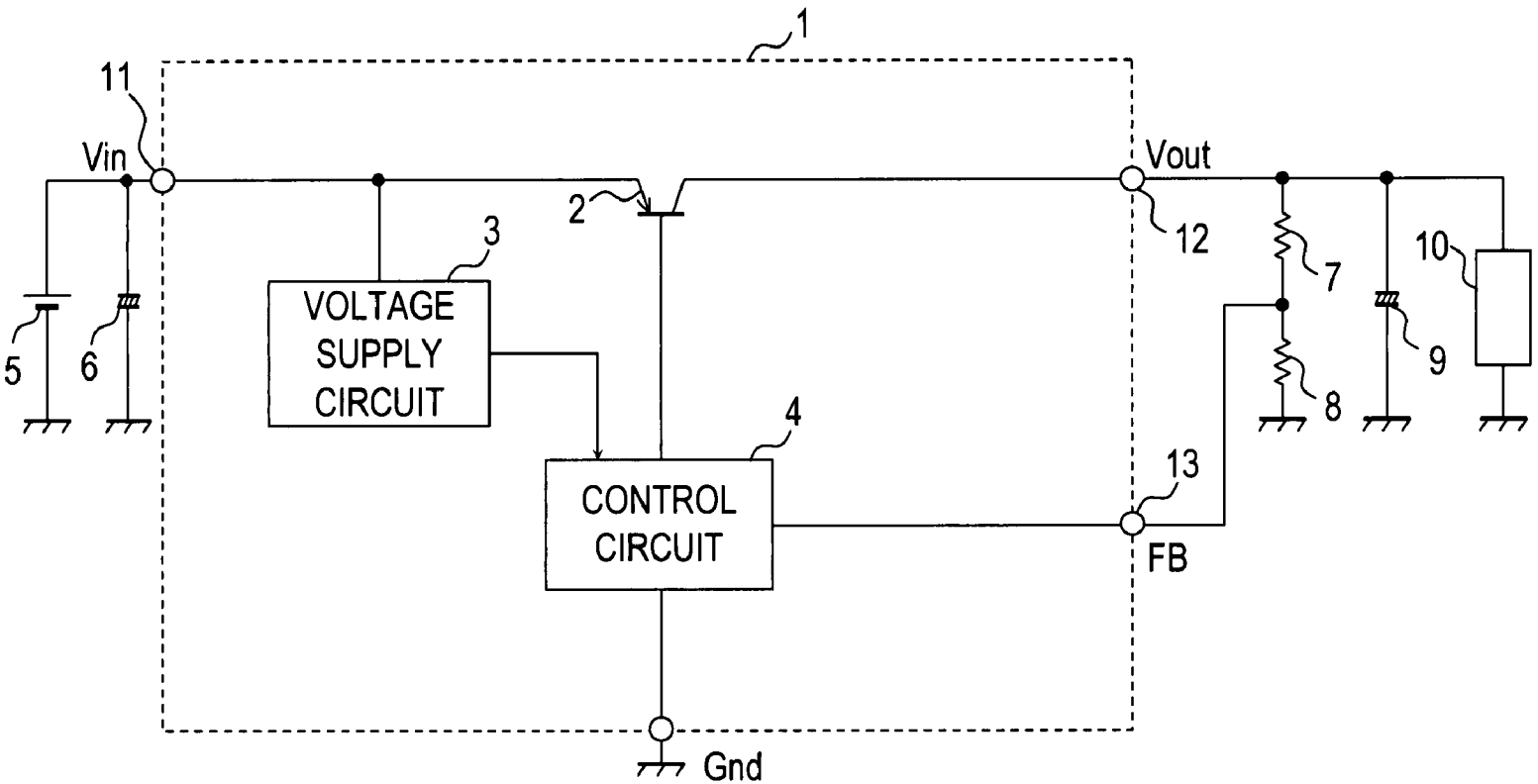
FIG. 1 is a circuit diagram of the direct-current stabilized power supply device according to a first embodiment of the present invention.

Hereinafter, the direct-current stabilized power supply device of a first embodiment of the present invention will be described. FIG. 1 is a circuit diagram of a direct-current stabilized power supply device 1 (hereinafter simply referred to as a "power supply device 1") of the first embodiment.

The power supply device 1 is built with an output transistor 2 used as an output element, a control circuit 4 that controls the output transistor 2, and a voltage supply circuit 3 that feeds to the control circuit 4 a supply voltage for driving the control circuit 4.

An input voltage Vin outputted from a direct current power source 5 is fed to the emitter of the output transistor 2, which is a PNP bipolar transistor, and to the voltage supply circuit 3 via an input terminal 11. The output of the direct current power source 5 is grounded via a capacitor 6 (that is, connected to a ground used as a reference potential). The collector of the output transistor 2 is connected to an output terminal 12. The output terminal 12 is connected to a load 10, and is grounded via a circuit in which voltage dividing resistances 7 and 8 are connected in series and a capacitor 9. An output voltage Vout of the power supply device 1 is outputted from the output terminal 12, and the load 10 operates from the output voltage Vout.

A voltage at a node at which the voltage dividing resistances 7 and 8 are connected together is fed to the control circuit 4 as a feedback voltage via a feedback terminal 13. The control circuit 4 controls a base current (a base potential) of the output transistor 2 so that the feedback voltage is kept at a given level. This stabilizes the output voltage Vout at a predetermined constant voltage.

Figure 10:
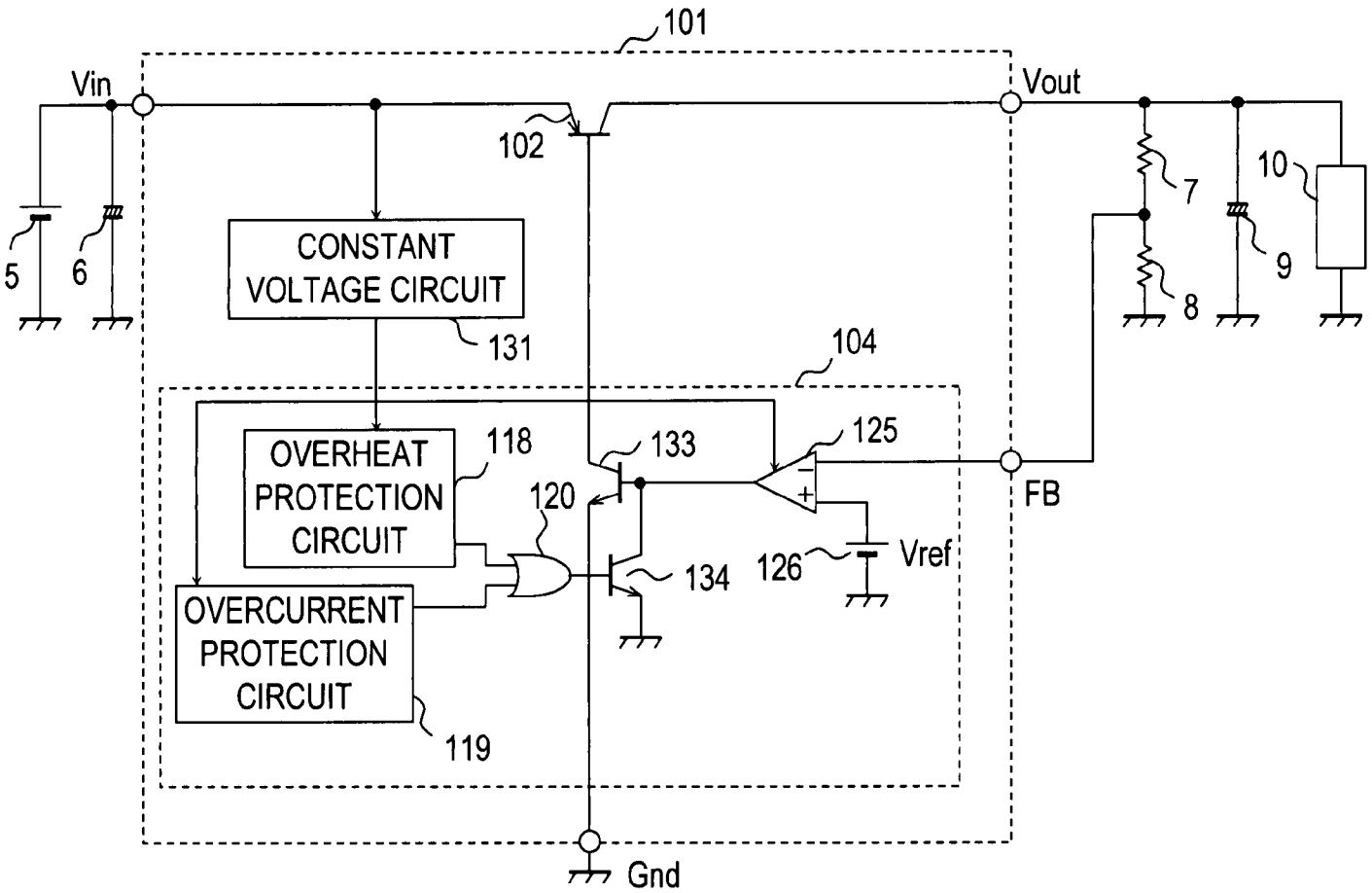
FIG.10 PRIOR ART
FIG. 10 is a circuit diagram of a conventional direct-current stabilized power supply device.

The voltage supply circuit 3 steps down the input voltage Vin, and then outputs the voltage thus obtained as a supply voltage for driving the control circuit 4. As compared to a conventional direct-current stabilized power supply device shown in FIG. 10, this helps reduce the loss corresponding to electric power calculated as follows: (the input voltage Vin minus the supply voltage of the control circuit 4) multiplied by the current consumption of the control circuit 4, contributing to reduction of electric power consumption of the power supply device itself

Second Embodiment

Figure 2:
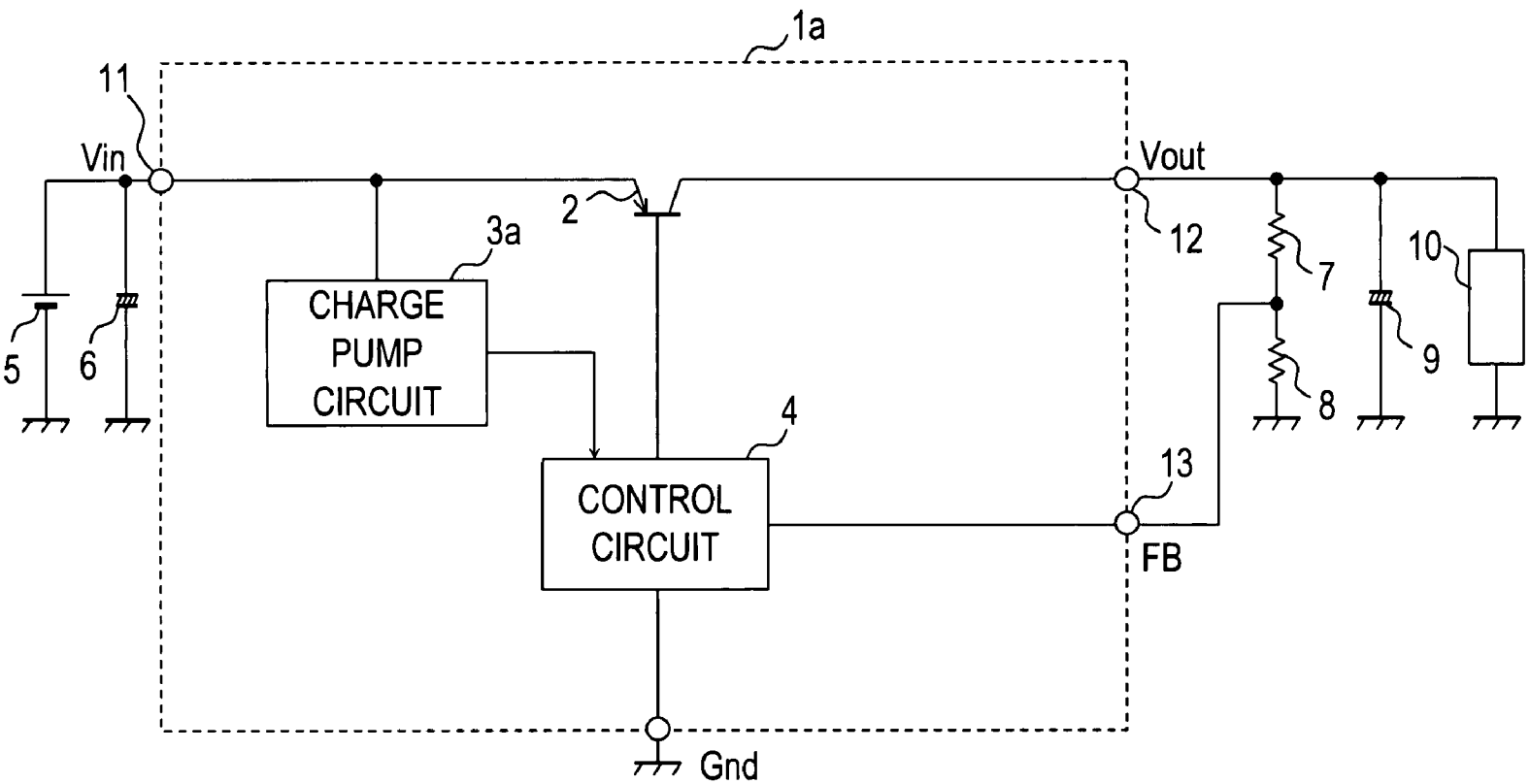
FIG. 2 is a circuit diagram of the direct-current stabilized power supply device according to a second embodiment of the present invention.

Next, the direct-current stabilized power supply device of a second embodiment of the present invention will be described. FIG. 2 is a circuit diagram of a direct-current stabilized power supply device la (hereinafter simply referred to as a "power supply device 1*a*") of the second embodiment.

The power supply device la is built with an output transistor 2 used as an output element, a control circuit 4 that controls the output transistor 2, and a charge pump circuit 3*a* that feeds to the control circuit 4 a supply voltage for driving the control circuit 4. Specifically, in the power supply device 1*a*, a voltage supply circuit that feeds a supply voltage to the control circuit 4 is built as the charge pump circuit 3*a*. FIG. 2 is otherwise identical to FIG. 1 in terms of the circuit configuration and operations of individual circuit blocks, and therefore their explanations will not be repeated. In FIG. 2, such circuit blocks and components as are found also in FIG. 1 are identified with the same reference characters.

The control circuit 4 controls a base current (a base potential) of the output transistor 2 so that a voltage (a feedback voltage) at a node at which voltage dividing resistances 7 and 8 are connected together is kept at a given level. This stabilizes the output voltage Vout at a predetermined constant voltage.

The charge pump circuit 3*a* is fed with an input voltage Vin, and then feeds a voltage equal to half the input voltage Vin, for example, to the control circuit 4 as a supply voltage. Specifically, the charge pump circuit 3*a* steps down the input voltage Vin, and then outputs the voltage thus obtained as a supply voltage for driving the control circuit 4. As compared to the conventional direct-current stabilized power supply device shown in FIG. 10, this helps reduce the loss corresponding to electric power calculated as follows: (the input voltage Vin minus the supply voltage of the control circuit 4) multiplied by the current consumption of the control circuit 4, contributing to reduction of electric power consumption of the power supply device itself

Third Embodiment

Figure 3:
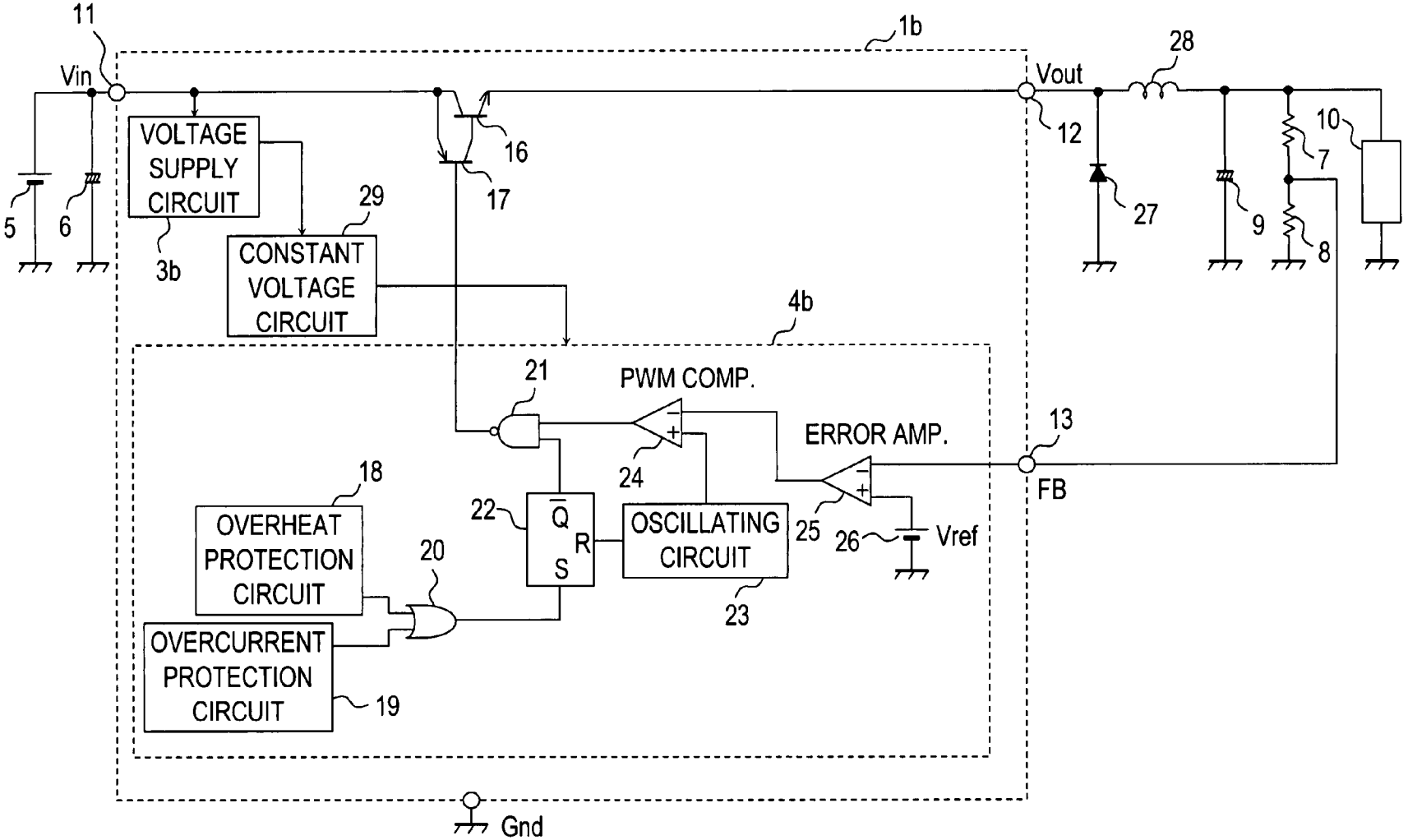
FIG. 3 is a circuit diagram of the direct-current stabilized power supply device according to a third embodiment of the present invention.

Next, the direct-current stabilized power supply device of a third embodiment of the present invention will be described. FIG. 3 is a circuit diagram of a direct-current stabilized power supply device 1*b* (hereinafter simply referred to as a "power supply device 1*b*") of the third embodiment. In FIG. 3, such circuit blocks and components as are found also in FIG. 1 are identified with the same reference characters.

The power supply device 1*b* is built with an output transistor 16, which is an NPN bipolar transistor, a transistor 17, which is a PNP bipolar transistor, a control circuit 4*b* that controls the output transistor 16, a voltage supply circuit 3*b* that outputs a voltage for driving the control circuit 4*b*, and a constant voltage circuit 29 that stabilizes the output voltage of the voltage supply circuit 3*b* at a predetermined voltage and then feeds the stabilized voltage to the control circuit 4*b* as a supply voltage. The constant voltage circuit 29 is built as a constant voltage diode or a shunt regulator, for example.

The control circuit 4*b* is composed of a reference voltage source 26 that outputs a reference voltage Vref, an error amplifier (ERROR AMP.) 25, an oscillating circuit 23, a PWM comparator (PWM COMP.) 24, a flip-flop 22, a NAND circuit 21, an overcurrent protection circuit 19 for overcurrent protection, an overheating protection circuit 18 for protection against an abnormal increase in heat, and an OR circuit 20.

An input voltage Vin outputted from a direct current power source 5 is applied to an input terminal 11. This input terminal 11 is connected to the collector of the output transistor 16 and the emitter of the transistor 17, and is connected to the voltage supply circuit 3*b*. The output of the direct current power source 5 is grounded via a capacitor 6 (that is, connected to a ground used as a reference potential).

The emitter of the output transistor 16 is connected to an output terminal 12, and the output terminal 12 is connected to the cathode of a diode 27 and to one end of a coil 28. The other end of the coil 28 is grounded via a capacitor 9 and via a circuit in which voltage dividing resistances 7 and 8 are connected in series, and is connected to a load 10. The anode of the diode 27 is grounded.

A voltage at a node at which the voltage dividing resistances 7 and 8 are connected together is fed to the inverting input terminal (−) of the error amplifier 25 as a feedback voltage via a feedback terminal 13. The reference voltage Vref is fed to the non-inverting input terminal (+) of the error amplifier 25. The error amplifier 25 amplifies the voltage error between the feedback voltage and the reference voltage Vref. The PWM comparator 24 receives, at the non-inverting input terminal (+) thereof, the output voltage of the error amplifier 25, and, at the inverting input terminal (−) thereof, a triangular wave outputted from the oscillating circuit 23. By comparing the triangular wave thus received with the output voltage of the error amplifier 25, the PWM comparator 24 feeds a pulse width modulated signal to the output transistor 16 via the NAND circuit 21.

When the output transistor 16 is on, a current flows from the input terminal 11 to the coil 28 via the output transistor 16. At this time, energy is accumulated in the coil 28, and a current is fed to the load 10 via the coil 28. On the other hand, when the output transistor 16 is off, the energy accumulated in the coil 28 is released via the diode 27. In this way, the feedback voltage is kept equal to the reference voltage Vref, and the voltage at a node at which the load 10, the capacitor 9, and the voltage dividing resistance 7 are connected together, that is, the output voltage Vout of the power supply device 1*b* is kept at a constant level. The load 10 performs predetermined operations by using the output voltage Vout as a drive voltage. As described above, the power supply device 1*b* behaves as a chopper-type direct-current stabilized power supply device. Since the power supply device 1*b* requires the diode 27, the coil 28, and the capacitor 9 to obtain the output voltage Vout, it can be considered that the power supply device 1*b* is provided with the diode 27, the coil 28, and the capacitor 9.

The overheating protection circuit 18 protects the power supply device of the present invention (in this embodiment, the power supply device 1*b*) by monitoring the temperature of a particular component of the power supply device, and forcing the output transistor 16 to be turned off by outputting a high level voltage when the temperature exceeds a predetermined threshold temperature. For example, when a junction temperature of the output transistor (in this embodiment, the output transistor 16) reaches (or is considered to reach) a predetermined threshold temperature due to an increase in internal heat resulting from a heavy load or an abnormal increase in the ambient temperature, the overheating protection circuit 18 outputs a high level voltage. This helps prevent the output transistor from being damaged by heat.

The overcurrent protection circuit 19 protects the power supply device (in this embodiment, the power supply device 1*b*) from overcurrent by limiting an output current flowing from the output terminal 12 so that it does not exceed a predetermined current limit. When the output current reaches the current limit, the overcurrent protection circuit 19 forces the output transistor 16 to be turned off by outputting a high level voltage.

To realize the above described operations, the output of the overheating protection circuit 18 is fed to one input terminal of the OR circuit 20, and the output of the overcurrent protection circuit 19 is fed to the other input terminal of the OR circuit 20. The output of the OR circuit 20 is connected to the set terminal of the flip-flop 22, and the inverting output terminal of the flip-flop 22 is connected to one input terminal of the NAND circuit 21. The output of the PWM comparator 24 is connected to the other input terminal of the NAND circuit 21. When the set terminal of the flip-flop 22 takes a high level, the flip-flop 22 outputs, from the inverting output terminal thereof, a low level voltage signal, and continues to output the low level voltage signal until the input of the reset terminal thereof takes a high level. Incidentally, a rectangular wave that is synchronous with the triangular wave generated by the oscillating circuit 23 is fed to the reset terminal of the flip-flop 22. The output of the NAND circuit 21 is connected to the base of the transistor 17, and the collector of the transistor 17 is connected to the base of the output transistor 16.

The voltage supply circuit 3*b* drives the control circuit 4*b* by stepping down the input voltage Vin and then feeding the voltage thus obtained to the control circuit 4*b* via the constant voltage circuit 29. As compared to the conventional direct-current stabilized power supply device shown in FIG. 10, this helps reduce the loss corresponding to electric power calculated as follows: (the input voltage Vin minus the output voltage of the voltage supply circuit 3*b*) multiplied by the current consumption of the control circuit 4*b*, contributing to reduction of electric power consumption of the power supply device itself

Fourth Embodiment

Figure 4:
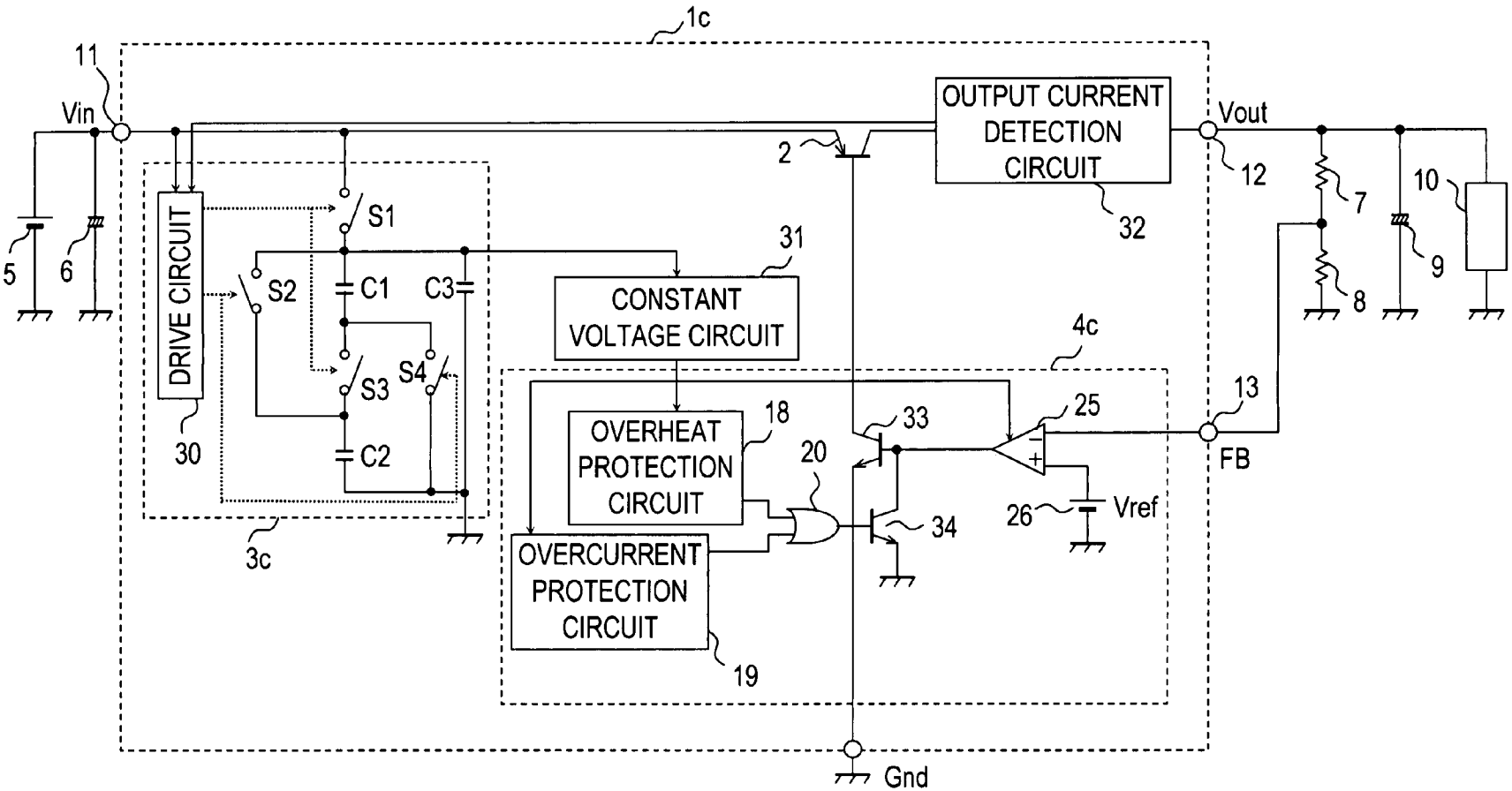
FIG. 4 is a circuit diagram of the direct-current stabilized power supply device according to a fourth embodiment of the present invention.

Next, the direct-current stabilized power supply device of a fourth embodiment of the present invention will be described. FIG. 4 is a circuit diagram of a direct-current stabilized power supply device 1*c* (hereinafter simply referred to as a "power supply device 1*c*") of the fourth embodiment. In FIG. 4, such circuit blocks and components as are found also in FIGS. 1 and 3 are identified with the same reference characters, and their explanations will not (in principle) be repeated.

The power supply device 1*c* is built with an output transistor 2 used as an output element, a control circuit 4*c* that controls the output transistor 2, a voltage supply circuit 3*c* that output a voltage for driving the control circuit 4*c*, a constant voltage circuit 31 that stabilizes the output voltage of the voltage supply circuit 3*c* at a predetermined voltage and then feeds the stabilized voltage to the control circuit 4*c* as a supply voltage, and an output current detection circuit 32. The constant voltage circuit 31 is built as a constant voltage diode or a shunt regulator, for example.

The control circuit 4*c* is composed of a reference voltage source 26 that outputs a reference voltage Vref, an error amplifier 25, an overheating protection circuit 18, an overcurrent protection circuit 19, an OR circuit 20, a drive transistor 33, which is an NPN bipolar transistor, and a transistor 34, which is an NPN bipolar transistor.

An input voltage Vin outputted from a direct current power source 5 is fed to the emitter of the output transistor 2 and to the voltage supply circuit 3*c* via an input terminal 11. The output of the direct current power source 5 is grounded via a capacitor 6 (that is, connected to a ground used as a reference potential). The collector of the output transistor 2 is connected to an output terminal 12 via the output current detection circuit 32. The output terminal 12 is connected to a load 10, and is grounded via a circuit in which voltage dividing resistances 7 and 8 are connected in series and a capacitor 9. An output voltage Vout of the power supply device 1*c* is outputted from the output terminal 12, and the load 10 operates from the output voltage Vout.

A voltage at a node at which the voltage dividing resistances 7 and 8 are connected together is fed to the inverting input terminal (−) of the error amplifier 25 as a feedback voltage via a feedback terminal 13. The reference voltage Vref is fed to the non-inverting input terminal (+) of the error amplifier 25. The error amplifier 25 amplifies the voltage error between the feedback voltage and the reference voltage Vref The collector of the drive transistor 33 is connected to the base of the output transistor 2, the base thereof is connected to the output of the error amplifier 25, and the emitter thereof is grounded. As a result, a base current (a base potential) of the output transistor 2 is controlled so that the feedback voltage is made equal to the reference voltage Vref. This makes it possible to keep the output voltage Vout at a predetermined constant voltage.

The overheating protection circuit 18 protects the power supply device of the present invention (in this embodiment, the power supply device 1*c*) by monitoring the temperature of a particular component of the power supply device, and forcing the output transistor 2 to be turned off by outputting a high level voltage when the temperature exceeds a predetermined threshold temperature. For example, when a junction temperature of the output transistor (in this embodiment, the output transistor 2) reaches (or is considered to reach) a predetermined threshold temperature due to an increase in internal heat resulting from a heavy load or an abnormal increase in the ambient temperature, the overheating protection circuit 18 outputs a high level voltage. This helps prevent the output transistor from being damaged by heat.

The overcurrent protection circuit 19 protects the power supply device (in this embodiment, the power supply device 1*c*) from overcurrent by limiting an output current flowing from the output terminal 12 so that it does not exceed a predetermined current limit. When the output current reaches the current limit, the overcurrent protection circuit 19 forces the output transistor 2 to be turned off by outputting a high level voltage.

The overheating protection circuit 18, the overcurrent protection circuit 19, and the OR circuit 20 are connected in the same manner as in the power supply device 1*b* of FIG. 3. The base of the transistor 34 is connected to the output of the OR circuit 20, the collector thereof is connected to the base of the drive transistor 33, and the emitter thereof is grounded. As a result, when overheat protection and/or overcurrent protection are made to operate and a high level signal is outputted from the overheating protection circuit 18 and/or the overcurrent protection circuit 19, the transistor 34 is turned on, and then the base voltage of the drive transistor 33 takes a low level (for example, 0.1 V). As a result, the base current of the output transistor 2 is interrupted, protecting the power supply device 1*c* from overheat and overcurrent.

The voltage supply circuit 3*c* is a charge pump circuit that is built with capacitors C1, C2, and C3, switching elements S1, S2, S3, and S4, each being composed of, for example, a MOS transistor (an insulated gate field-effect transistor), and a drive circuit 30 that drives the switching elements S1 to S4.

The switching elements S1, S2, S3, and S4 are connected in series in the order named, and the input voltage Vin is applied to each end of the circuit in which the switching elements S1, S2, S3, and S4 are connected in series. A terminal of the switching element S1 located on the side of the switching element S1 opposite to a node at which the switching elements S1 and S2 are connected together is connected to the input terminal 11, and a terminal of the switching element S4 located on the side of the switching element S4 opposite to a node at which the switching elements S3 and S4 are connected together is grounded. The node at which the switching elements S1 and S2 are connected together is connected, via the capacitor C1, to the node at which the switching elements S3 and S4 are connected together, and is grounded via the capacitor C3. A node at which the switching elements S2 and S3 are connected together is grounded via the capacitor C2. A voltage at the node at which the switching elements S1 and S2 are connected together is fed to the constant voltage circuit 31 as an output voltage of the voltage supply circuit 3*c*. The capacitances of the capacitors C1 and C2 are made equal to each other, for example.

The drive circuit 30 controls on/off of the switching elements S1 to S4 so as to alternately switch between a state in which the switching elements S1 and S3 are on and the switching elements S2 and S4 are off and a state in which the switching elements S1 and S3 are off and the switching elements S2 and S4 are on.

First, by turning on the switching elements S1 and S3, the capacitors C1 and C2 are charged by the input voltage Vin. Then, the switching elements S1 and S3 are turned off and the switching elements S2 and S4 are turned on. As a result, a voltage equal to half the input voltage Vin is fed to the constant voltage circuit 31. Note that the drive circuit 30 is fed with the input voltage Vin as a supply voltage for controlling on/off of the switching elements S1 to S4.

Assume that the input voltage Vin is 12 V. Then, the output voltage of the voltage supply circuit 3*c* is 6 V (approximately 6 V). The constant voltage circuit 31 steps down this 6 V voltage fed thereto to 2.7 V, for example, and then feeds the voltage thus obtained to the control circuit 4*c* (more specifically, the overheating protection circuit 18, the overcurrent protection circuit 19, the OR circuit 20, the error amplifier 25, and the reference voltage source 26) as a supply voltage. It is to be noted that the voltage supply circuit 3*c* and the constant voltage circuit 31 may be collectively viewed as a voltage supply circuit.

Assume that the current consumption of the control circuit 4*c* is 10 mA. Then, electric power consumed for driving the control circuit 4*c* is calculated as follows: the output voltage of the voltage supply circuit 3*c* × the current consumption of the control circuit 4*c*=6 V×10 mA=60 mW. On the other hand, assume that, as in the case of the conventional direct-current stabilized power supply device shown in FIG. 10, the input voltage Vin is directly fed to the constant voltage circuit. Then, electric power consumed for driving the control circuit 4*c* is calculated as follows: the input voltage Vin × the current consumption of the control circuit 4*c*=12 V×10 mA=120 mW. That is, by adopting the voltage supply circuit 3*c*, it is possible to achieve 60 mW (=120 mW−60 mW) reduction of electric power consumption. This contributes to energy saving.

The output current detection circuit 32 is built, for example, as a shunt resistance connected in series between the collector of the output transistor 2 and the output terminal 12, and detects the magnitude of the output current of the output transistor 2 (the output current of the power supply device 1*c*) based on the voltage drop across the shunt resistance. The output current detection circuit 32 transmits the detected magnitude of the output current to the drive circuit 30.

When the magnitude of the output current is relatively small, the drive circuit 30 makes relatively small the ratio (the duty ratio) of the on-period of the switching elements S1 and S3 to the sum of the on and off periods. On the other hand, when the magnitude of the output current is relatively large, the drive circuit 30 makes relatively large the ratio (the duty ratio) of the on-period of the switching elements S1 and S3 to the sum of the on and off periods. Specifically, as the magnitude of the output current of the output transistor 2 (the output current of the power supply device 1*c*) increases, the ratio (the duty ratio) of the on-period of the switching elements S1 and S3 to the sum of the on and off periods is made larger. As the ratio of the on-period of the switching elements S1 and S3 to the sum of the on and off periods is made larger, the amount of suppliable current of the voltage supply circuit 3*c*, that is, the amount of current the voltage supply circuit 3*c* can supply to the constant voltage circuit 31 (the control circuit 4*c*) increases.

When the output current of the output transistor 2 (the output current of the power supply device 1*c*) increases, the current needed to drive the drive transistor 33 increases, and thus the current consumption of the control circuit 4*c* itself increases. This raises concerns about a shortage of current supply of the voltage supply circuit 3*c*.

However, as described above, the current supply circuit 3*c* varies the amount of suppliable current thereof by varying the ratio (the duty ratio) of the on-period of the switching elements S1 and S3 to the sum of the on and off periods depending on the output current of the output transistor 2 (the output current of the power supply device 1*c*). This helps solve the shortage of current supply of the voltage supply circuit 3*c* that can occur with an increase in the output current.

Fifth Embodiment

Figure 5:
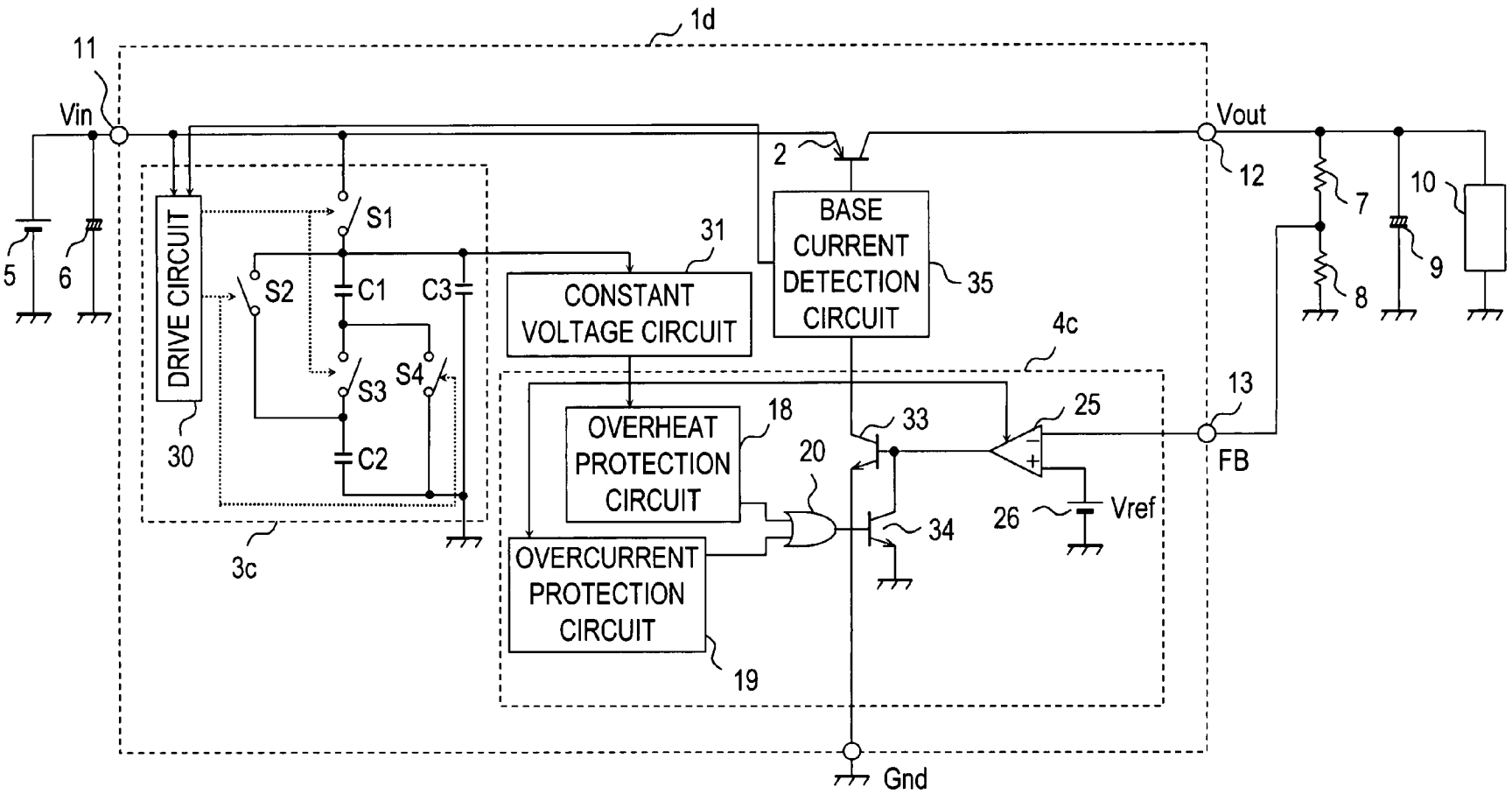
FIG. 5 is a circuit diagram of the direct-current stabilized power supply device according to a fifth embodiment of the present invention.

Next, the direct-current stabilized power supply device of a fifth embodiment of the present invention will be described. FIG. 5 is a circuit diagram of a direct-current stabilized power supply device 1*d* (hereinafter simply referred to as a "power supply device 1*d*") of the fifth embodiment. In FIG. 5, such circuit blocks and components as are found also in FIG. 4 are identified with the same reference characters, and their explanations will not (in principle) be repeated.

The power supply device 1*d* is built with an output transistor 2, a control circuit 4*c*, a voltage supply circuit 3*c*, a constant voltage circuit 31, and a base current detection circuit 35. The power supply device 1*d* of FIG. 5 is similar in circuit configuration and in operation to the power supply device 1*c* of FIG. 4, and the circuit configuration and operation of FIG. 5 are on the whole similar to those of FIG. 4. The power supply device 1*d* of FIG. 5 (the whole of FIG. 5) differs from the power supply device 1*c* of FIG. 4 (the whole of FIG. 4) in that an output current detection circuit 32 of FIG. 4 is replaced with the base current detection circuit 35. If not otherwise specified, the power supply device 1*d* of FIG. 5 (the whole of FIG. 5) is otherwise identical to the power supply device 1*c* of FIG. 4 (the whole of FIG. 4) in terms of the circuit configuration and operation, and their explanations will not be repeated.

The base current detection circuit 35 lies between the base of the output transistor 2 and the collector of the drive transistor 33. Since the output current detection circuit 32 provided for the power supply device 1*c* of FIG. 4 is omitted, the collector of the output transistor 2 is directly connected to an output terminal 12. An output voltage Vout of the power supply device 1*d* is outputted from the output terminal 12, and a load 10 operates from the output voltage Vout.

Since also in this embodiment the voltage supply circuit 3*c* is adopted, it is possible to achieve reduction of electric power consumption just as in the fourth embodiment.

The base current detection circuit 35 is built, for example, as a shunt resistance connected in series between the base of the output transistor 2 and the collector of the drive transistor 33, and detects the magnitude of the base current of the output transistor 2 based on the voltage drop across the shunt resistance. The base current detection circuit 35 transmits the detected magnitude of the base current to the drive circuit 30.

When the magnitude of the base current detected by the base current detection circuit 35 is relatively small, the drive circuit 30 makes relatively small the ratio (the duty ratio) of the on-period of the switching elements S1 and S3 to the sum of the on and off periods. On the other hand, when the magnitude of the base current is relatively large, the drive circuit 30 makes relatively large the ratio (the duty ratio) of the on-period of the switching elements S1 and S3 to the sum of the on and off periods. Specifically, as the magnitude of the base current of the output transistor 2 increases, the ratio (the duty ratio) of the on-period of the switching elements S1 and S3 to the sum of the on and off periods is made larger. As the ratio of the on-period of the switching elements S1 and S3 to the sum of the on and off periods is made larger, the amount of suppliable current of the voltage supply circuit 3*c*, that is, the amount of current the voltage supply circuit 3*c* can supply to the constant voltage circuit 31 (the control circuit 4*c*) increases.

The output current of the output transistor 2 (the output current of the power supply device 1*d*) is proportional to the base current of the output transistor 2. Thus, as the base current of the output transistor 2 increases, the output current of the output transistor 2 (the output current of the power supply device 1*d*) increases. When the output current of the output transistor 2 (the output current of the power supply device 1*d*) increases, the current needed to drive the drive transistor 33 increases, and thus the current consumption of the control circuit 4*c* itself increases. This raises concerns about a shortage of current supply of the voltage supply circuit 3*c*.

However, as described above, the current supply circuit 3*c* varies the amount of suppliable current thereof by varying the ratio (the duty ratio) of the on-period of the switching elements S1 and S3 to the sum of the on and off periods depending on the base current of the output transistor 2. This helps solve the shortage of current supply of the voltage supply circuit 3*c* that can occur with an increase in the output current.

Sixth Embodiment

Figure 6:
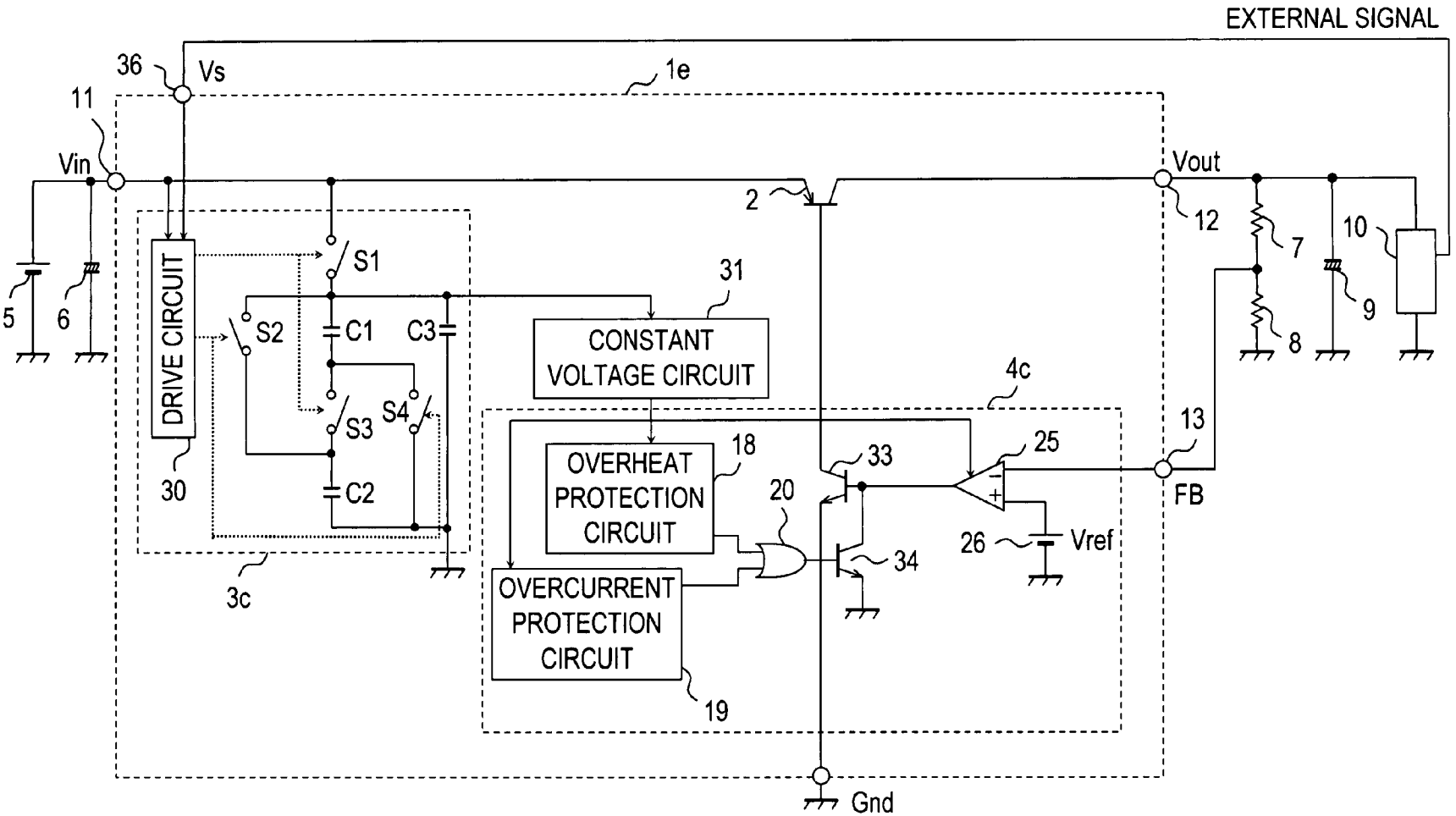
FIG. 6 is a circuit diagram of the direct-current stabilized power supply device according to a sixth embodiment of the present invention.

Next, the direct-current stabilized power supply device of a sixth embodiment of the present invention will be described. FIG. 6 is a circuit diagram of a direct-current stabilizes an output voltage by controlling a duty ratio at which an output transistor is turned stabilized power supply device 1*e* (hereinafter simply referred to as a "power supply device 1*e*") of the sixth embodiment. In FIG. 6, such circuit blocks and components as are found also in FIG. 4 are identified with the same reference characters, and their explanations will not (in principle) be repeated.

The power supply device 1*e* is built with an output transistor 2, a control circuit 4*c*, a voltage supply circuit 3*c*, and a constant voltage circuit 31. The power supply device 1*e* of FIG. 6 is similar in circuit configuration and in operation to the power supply device 1*c* of FIG. 4, and the circuit configuration and operation of FIG. 6 are on the whole similar to those of FIG. 4. The power supply device 1*e* of FIG. 6 (the whole of FIG. 6) differs from the power supply device 1*c* of FIG. 4 (the whole of FIG. 4) in that an output current detection circuit 32 of FIG. 4 is omitted, and an external signal indicating the operating state of a load 10 is fed to a drive circuit 30 via an external signal input terminal (Vs) 36. If not otherwise specified, the power supply device 1*e* of FIG. 6 (the whole of FIG. 6) is otherwise identical to the power supply device 1*c* of FIG. 4 (the whole of FIG. 4) in terms of the circuit configuration and operation, and their explanations will not be repeated.

Since the output current detection circuit 32 provided for the power supply device 1*c* of FIG. 4 is omitted, the collector of the output transistor 2 is directly connected to an output terminal 12. An output voltage Vout of the power supply device 1*e* is outputted from the output terminal 12, and the load 10 operates from the output voltage Vout.

Since also in this embodiment the voltage supply circuit 3*c* is adopted, it is possible to achieve reduction of electric power consumption just as in the fourth embodiment.

The power supply device 1*e* is used as a power supply device for driving a cellular phone (not shown), for example, and the load 10 is a component of the cellular phone, such as a display portion (not shown) built with a liquid crystal panel and the like or a microcomputer (not shown) performing various controls. The load 10 operates in a normal operating state in which a telephone call, for example, is in progress, or in a standby state in which, for example, no operation is performed by the user. It is to be noted that the load 10 may operate in any other operating state than specifically described above. When the load 10 operates in a normal operating state, the electric power consumption thereof is relatively high. On the other hand, when in a standby state, the electric power consumption of the load 10 is lower than that required in a normal operating state.

A signal for indicating an operating state of the load 10 is fed from the microcomputer, for example, built in the load 10 to the drive circuit 30 as an external signal. Based on this external signal thus received, the drive circuit 30 recognizes whether the load 10 is in a normal operating state or in a standby state.

When the load 10 is found to be in a standby state, the drive circuit 30 makes relatively small the ratio (the duty ratio) of the on-period of the switching elements S1 and S3 to the sum of the on and off periods. On the other hand, when the load 10 is found to be in a normal operating state, the drive circuit 30 makes the ratio (the duty ratio) of the on-period of the switching elements S1 and S3 to the sum of the on and off periods larger than that observed in a standby state. As the ratio of the on-period of the switching elements S1 and S3 to the sum of the on and off periods is made larger, the amount of suppliable current of the voltage supply circuit 3*c*, that is, the amount of current the voltage supply circuit 3*c* can supply to the constant voltage circuit 31 (the control circuit 4*c*) increases.

When the load 10 is in a normal operating state, the output current of the output transistor 2 (the output current of the power supply device 1*e*) is higher than that required in a standby state. When the output current of the output transistor 2 (the output current of the power supply device 1*e*) increases, the current needed to drive the drive transistor 33 increases, and thus the current consumption of the control circuit 4*c* itself increases. This raises concerns about a shortage of current supply of the voltage supply circuit 3*c*.

However, as described above, the current supply circuit 3*c* varies the amount of suppliable current thereof by varying the ratio (the duty ratio) of the on-period of the switching elements S1 and S3 to the sum of the on and off periods depending on the external signal indicating an operating state of the load 10. This helps solve the shortage of current supply of the voltage supply circuit 3*c* that can occur with an increase in the electric power consumption of the load 10.

Seventh Embodiment

Figure 7:
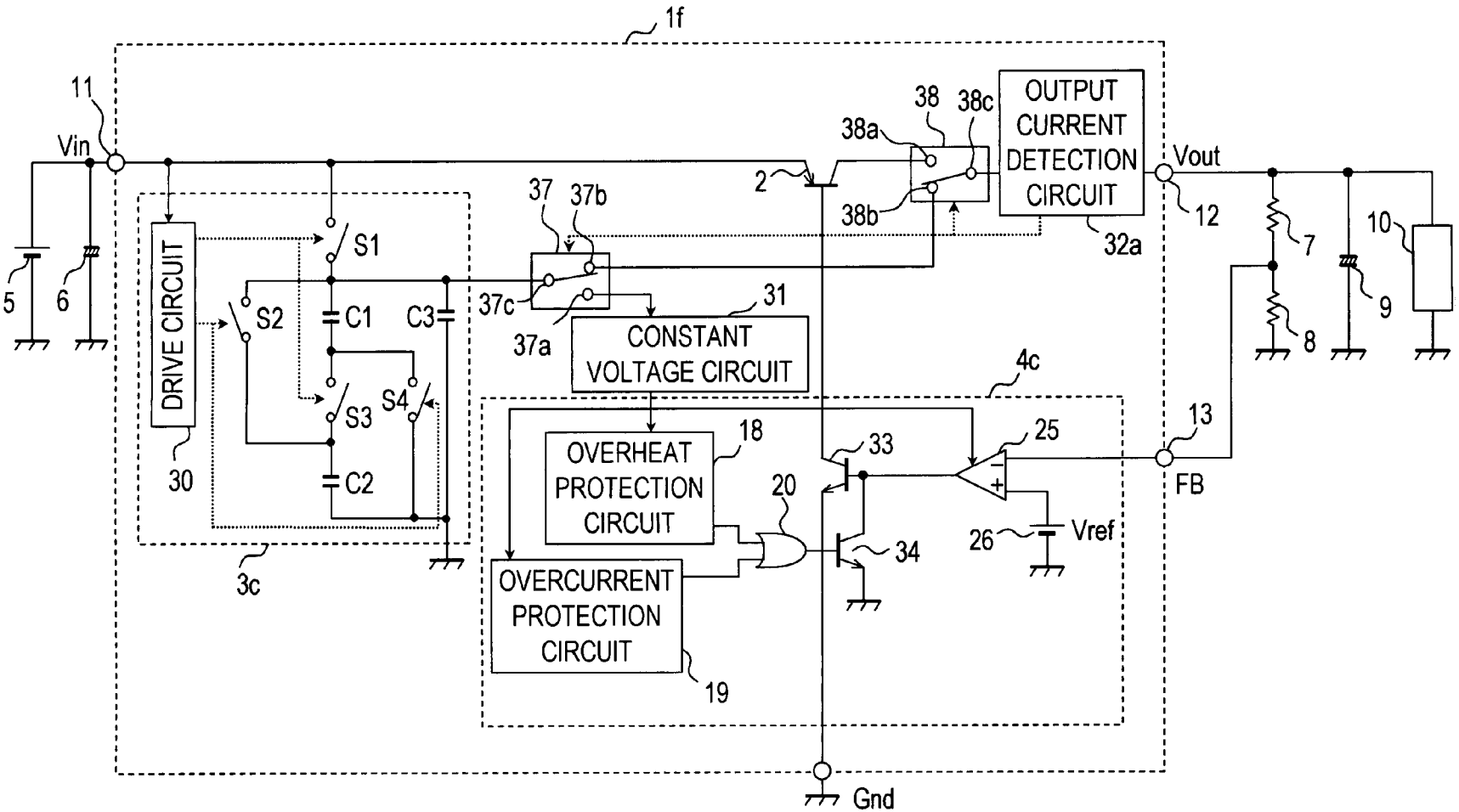
FIG. 7 is a circuit diagram of the direct-current stabilized power supply device according to a seventh embodiment of the present invention.

Next, the direct-current stabilized power supply device of a seventh embodiment of the present invention will be described. FIG. 7 is a circuit diagram of a direct-current stabilized power supply device 1*f* (hereinafter simply referred to as a "power supply device 1*f*") of the seventh embodiment. In FIG. 7, such circuit blocks and components as are found also in FIG. 4 are identified with the same reference characters, and their explanations will not (in principle) be repeated.

The power supply device 1*f* is built with an output transistor 2, a control circuit 4*c*, a voltage supply circuit 3*c*, a constant voltage circuit 31, an output current detection circuit 32*a*, and switch circuits 37 and 38. The power supply device 1*f* of FIG. 7 is similar in circuit configuration and in operation to the power supply device 1*c* of FIG. 4, and the circuit configuration and operation of FIG. 7 are on the whole similar to those of FIG. 4.

The power supply device 1*f* of FIG. 7 (the whole of FIG. 7) differs from the power supply device 1*c* of FIG. 4 (the whole of FIG. 4) in that an output current detection circuit 32 of FIG. 4 is replaced with the output current detection circuit 32*a*, the switch circuit 38 lies between the collector of the output transistor 2 and an output terminal 12, and the switch circuit 37 lies between the output of the voltage supply circuit 3*c* and the constant voltage circuit 31. If not otherwise specified, the power supply device 1*f* of FIG. 7 (the whole of FIG. 7) is otherwise identical to the power supply device 1*c* of FIG. 4 (the whole of FIG. 4) in terms of the circuit configuration and operation, and their explanations will not be repeated.

The switch circuit 37 has a first terminal 37*a*, a second terminal 37*b*, and a common terminal 37*c*, and selectively connects the first terminal 37*a* or the second terminal 37*b* to the common terminal 37*c* depending on a selection signal fed thereto. Specifically, when the selection signal takes a high level, the first terminal 37*a* is connected to the common terminal 37*c*. On the other hand, when the selection signal takes a low level, the second terminal 37*b* is connected to the common terminal 37*c*. FIG. 7 shows a state in which the second terminal 37*b* is connected to the common terminal 37*c*.

The switch circuit 38 has a first terminal 38*a*, a second terminal 38*b*, and a common terminal 38*c*, and selectively connects the first terminal 38*a* or the second terminal 38*b* to the common terminal 38*c* depending on a selection signal fed thereto. Specifically, when the selection signal takes a high level, the first terminal 38*a* is connected to the common terminal 38*c*. On the other hand, when the selection signal takes a low level, the second terminal 38*b* is connected to the common terminal 38*c*. FIG. 7 shows a state in which the second terminal 38*b* is connected to the common terminal 38*c*.

In the switch circuit 37, the first terminal 37*a* is connected to the constant voltage circuit 31, the second terminal 37*b* is connected to the second terminal 38*b* of the switch circuit 38, and the common terminal 37*c* is connected to the output of the voltage supply circuit 3*c* (the node at which switching elements S1 and S2 are connected together). In the switch circuit 38, the first terminal 38*a* is connected to the collector of the output transistor 2, and the common terminal 38*c* is connected to the output current detection circuit 32*a*.

The output current detection circuit 32*a* is built, for example, as a shunt resistance connected in series between the common terminal 38*c* and the output terminal 12, and detects the magnitude of a current outputted from the output terminal 12 (the output current of the power supply device 1*f*) based on the voltage drop across the shunt resistance. When the detected magnitude of the current is larger than a predetermined first current threshold value, the output current detection circuit 32*a* outputs a high level selection signal to the switch circuits 37 and 38. On the other hand, when the detected magnitude of the current is equal to or smaller than the first current threshold value, the output current detection circuit 32*a* outputs a low level selection signal to the switch circuits 37 and 38.

As a result, when the magnitude of the output current of the power supply device 1*f* is larger than the first current threshold value, the output voltage of the voltage supply circuit 3*c* is fed to the constant voltage circuit 31 via the common terminal 37*c* and the first terminal 37*a*, and the collector of the output transistor 2 is connected to the output terminal 12 via the first terminal 38*a* and the common terminal 38*c* (and the output current detection circuit 32*a*). This makes the power supply device 1*f* operate in a manner similar to the power supply device 1*c* of FIG. 4. That is, the base current of the output transistor 2 is controlled so that a voltage (a feedback voltage) at a node at which voltage dividing resistances 7 and 8 are connected together is made equal to the reference voltage Vref, and the output voltage Vout outputted from the output terminal 12 is kept at a constant voltage. Additionally, since the voltage supply circuit 3*c* feeds a voltage to the control circuit 4*c* via the constant voltage circuit 31, it is possible to achieve reduction of electric power consumption just as in the fourth embodiment.

On the other hand, when the magnitude of the output current of the power supply device 1*f* is equal to or smaller than the first current threshold value, the voltage supply circuit 3*c* feeds electric power to the load 10 via the common terminal 37*c*, the second terminal 37*b*, the second terminal 38*b*, and the common terminal 38*c* (and the output current detection circuit 32*a*). That is, when the current consumption of the load 10 is low, the voltage supply circuit 3*c* feeds electric power to the load 10 and the supply of voltage to the control circuit 4*c* is interrupted, because there is no need to make the control circuit 4*c* operate to feed electric power to the load 10. As a result, when the electric power consumption of the load 10 is low (for example, when the load 10 is in a standby state), it is possible to reduce electric power consumption for driving the control circuit 4*c*, realizing energy saving.

As described in the sixth embodiment, the load 10 operates in a normal operating state or in a standby state in which it requires lower electric power consumption than in a normal operating state. The first current threshold value is set so that, in a normal operating state, the magnitude of the current consumption of the load 10 (in principle) exceeds the first current threshold value, and, in a standby state, the magnitude of the current consumption of the load 10 becomes equal to or smaller than the first current threshold value.

Note that this embodiment can be used in combination with the fourth embodiment. Specifically, the output current detection circuit 32*a* may be made to transmit the detection result to the drive circuit 30 so that the ratio (the duty ratio) of the on-period of the switching elements S1 and S3 to the sum of the on and off periods increases with an increase in the magnitude of the output current of the power supply device 1*f*.

Eighth Embodiment

Figure 8:
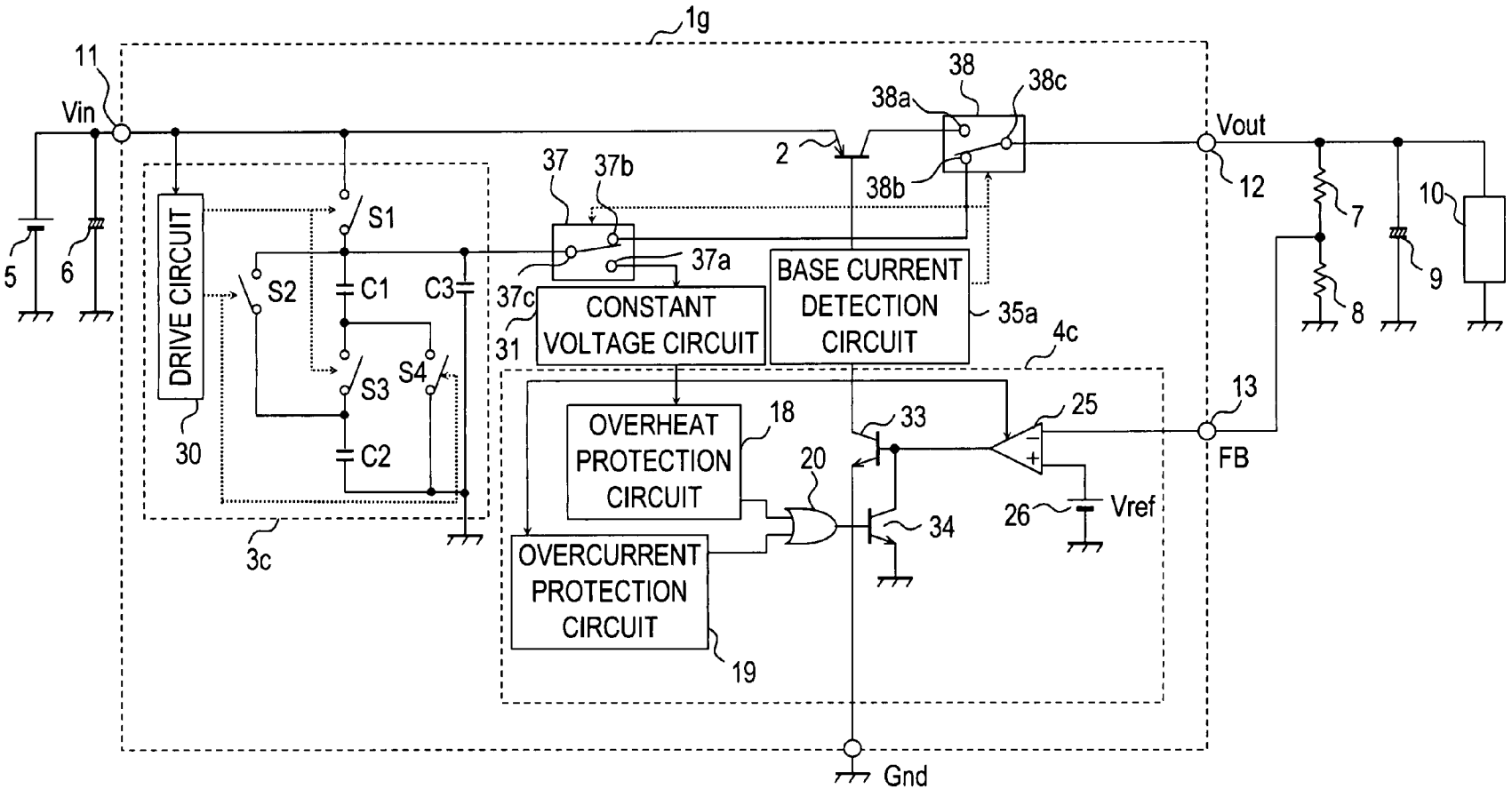
FIG. 8 is a circuit diagram of the direct-current stabilized power supply device according to an eighth embodiment of the present invention.

Next, the direct-current stabilized power supply device of an eighth embodiment of the present invention will be described. FIG. 8 is a circuit diagram of a direct-current stabilized power supply device 1*g* (hereinafter simply referred to as a "power supply device 1*g*") of the eighth embodiment. In FIG. 8, such circuit blocks and components as are found also in FIG. 7 are identified with the same reference characters, and their explanations will not (in principle) be repeated.

The power supply device 1*g* is built with an output transistor 2, a control circuit 4*c*, a voltage supply circuit 3*c*, a constant voltage circuit 31, a base current detection circuit 35*a*, and switch circuits 37 and 38. The power supply device 1*g* of FIG. 8 is similar in circuit configuration and in operation to the power supply device 1*f* of FIG. 7, and the circuit configuration and operation of FIG. 8 are on the whole similar to those of FIG. 7. The power supply device 1*g* of FIG. 8 (the whole of FIG. 8) differs from the power supply device 1*f* of FIG. 7 (the whole of FIG. 7) in that an output current detection circuit 32*a* of FIG. 7 is replaced with the base current detection circuit 35*a*. If not otherwise specified, the power supply device 1*g* of FIG. 8 (the whole of FIG. 8) is otherwise identical to the power supply device If of FIG. 7 (the whole of FIG. 7) in terms of the circuit configuration and operation, and their explanations will not be repeated.

The base current detection circuit 35*a* lies between the base of the output transistor 2 and the collector of the drive transistor 33. Since the output current detection circuit 32*a* provided for the power supply device 1*f* of FIG. 7 is omitted, the common terminal 38*c* of the switch circuit 38 is directly connected to an output terminal 12. An output voltage Vout of the power supply device 1*g* is outputted from the output terminal 12, and a load 10 operates from the output voltage Vout.

The base current detection circuit 35*a* is built, for example, as a shunt resistance connected in series between the base of the output transistor 2 and the collector of the drive transistor 33, and detects the magnitude of the base current of the output transistor 2 based on the voltage drop across the shunt resistance. When the detected magnitude of the base current is larger than a predetermined second current threshold value, the base current detection circuit 35*a* outputs a high level selection signal to the switch circuits 37 and 38. On the other hand, when the detected magnitude of the base current is equal to or smaller than the second current threshold value, the base current detection circuit 35*a* outputs a low level selection signal to the switch circuits 37 and 38.

As a result, when the magnitude of the base current of the output transistor 2 is larger than the second current threshold value, that is, the magnitude of the output current of the power supply device 1*g* is relatively large, the output voltage of the voltage supply circuit 3*c* is fed to the constant voltage circuit 31 via the common terminal 37*c* and the first terminal 37*a*, and the collector of the output transistor 2 is connected to the output terminal 12 via the first terminal 38*a* and the common terminal 38*c*. This makes the power supply device 1*g* operate in a manner similar to the power supply device 1*c* of FIG. 4. That is, the base current of the output transistor 2 is controlled so that a voltage (a feedback voltage) at a node at which voltage dividing resistances 7 and 8 are connected together is made equal to the reference voltage Vref, and the output voltage Vout outputted from the output terminal 12 is kept at a constant voltage. Additionally, since the voltage supply circuit 3*c* feeds a voltage to the control circuit 4*c* via the constant voltage circuit 31, it is possible to achieve reduction of electric power consumption just as in the fourth embodiment.

On the other hand, when the magnitude of the base current of the output transistor 2 is equal to or smaller than the second current threshold value, that is, the magnitude of the output current of the power supply device 1*g* is relatively small, the voltage supply circuit 3*c* feeds electric power to the load 10 via the common terminal 37*c*, the second terminal 37*b*, the second terminal 38*b*, and the common terminal 38*c*. Specifically, when the base current of the output transistor 2 is low (that is, the current consumption of the load 10 is low), the voltage supply circuit 3*c* feeds electric power to the load 10 and the supply of voltage to the control circuit 4*c* is interrupted, because there is no need to make the control circuit 4*c* operate to feed electric power to the load 10. As a result, when the electric power consumption of the load 10 is low (for example, when the load 10 is in a standby state), it is possible to reduce electric power consumption for driving the control circuit 4*c*, realizing energy saving.

As described in the sixth embodiment, the load 10 operates in a normal operating state or in a standby state in which it requires lower electric power consumption than in a normal operating state. The second current threshold value is set so that, in a normal operating state, the magnitude of the base current of the output transistor 2 (in principle) exceeds the second current threshold value, and, in a standby state, the magnitude of the base current of the output transistor 2 becomes equal to or smaller than the second current threshold value.

Note that this embodiment can be used in combination with the fifth embodiment. Specifically, the base current detection circuit 35*a* may be made to transmit the detection result to the drive circuit 30 so that the ratio (the duty ratio) of the on-period of the switching elements S1 and S3 to the sum of the on and off periods increases with an increase in the magnitude of the base current of the output transistor 2.

Ninth Embodiment

Figure 9:
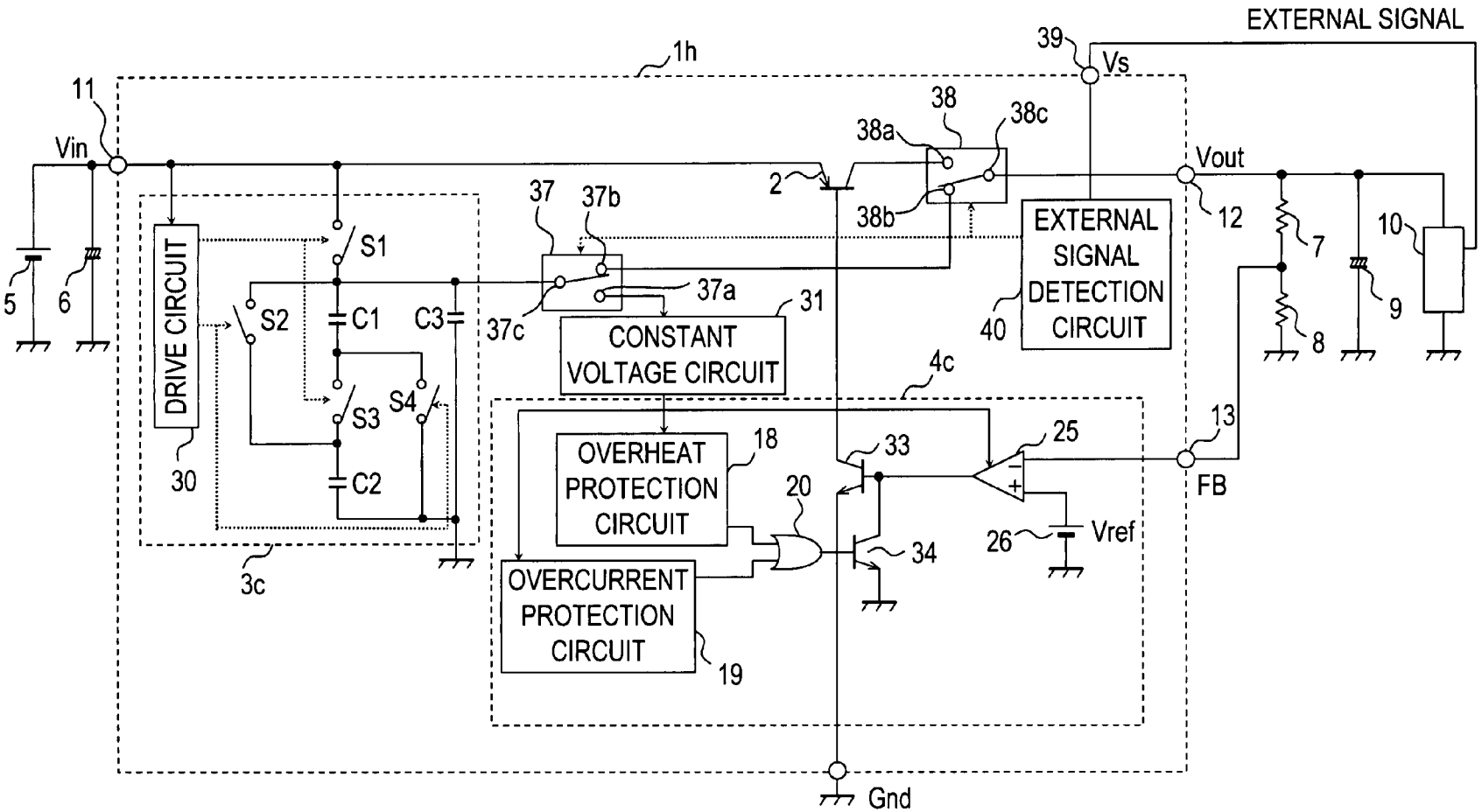
FIG. 9 is a circuit diagram of the direct-current stabilized power supply device according to a ninth embodiment of the present invention.

Next, the direct-current stabilized power supply device of a ninth embodiment of the present invention will be described. FIG. 9 is a circuit diagram of a direct-current stabilized power supply device 1*h* (hereinafter simply referred to as a "power supply device 1*h*") of the ninth embodiment. In FIG. 9, such circuit blocks and components as are found also in FIG. 7 are identified with the same reference characters, and their explanations will not (in principle) be repeated.

The power supply device 1*h* is built with an output transistor 2, a control circuit 4*c*, a voltage supply circuit 3*c*, a constant voltage circuit 31, an external signal detection circuit 40, and switch circuits 37 and 38. The power supply device 1*h* of FIG. 9 is similar in circuit configuration and in operation to the power supply device 1*f* of FIG. 7, and the circuit configuration and operation of FIG. 9 are on the whole similar to those of FIG. 7.

The power supply device 1*h* of FIG. 9 (the whole of FIG. 9) differs from the power supply device 1*f* of FIG. 7 (the whole of FIG. 7) in that an output current detection circuit 32*a* of FIG. 7 is omitted, and the external signal detection circuit 40 that receives, via an external signal input terminal (Vs) 39, an external signal indicating an operating state of a load 10 is additionally provided. If not otherwise specified, the power supply device 1*h* of FIG. 9 (the whole of FIG. 9) is otherwise identical to the power supply device 1*f* of FIG. 7 (the whole of FIG. 7) in terms of the circuit configuration and operation, and their explanations will not be repeated.

Since the output current detection circuit 32*a* provided for the power supply device 1*f* of FIG. 7 is omitted, the common terminal 38*c* of the switch circuit 38 is directly connected to an output terminal 12. An output voltage Vout of the power supply device 1*h* is outputted from the output terminal 12, and the load 10 operates from the output voltage Vout.

The power supply device 1*h* is used as a power supply device for driving a cellular phone (not shown), for example, and the load 10 is a component of the cellular phone, such as a display portion (not shown) built with a liquid crystal panel and the like or a microcomputer (not shown) performing various controls. The load 10 operates in a normal operating state in which a telephone call, for example, is in progress, or in a standby state in which, for example, no operation is performed by the user. It is to be noted that the load 10 may operate in any other operating state than specifically described above. When the load 10 operates in a normal operating state, the electric power consumption thereof is relatively high. On the other hand, when in a standby state, the electric power consumption of the load 10 is lower than that required in a normal operating state.

A signal for indicating an operating state of the load 10 is fed from the microcomputer, for example, built in the load 10 to the external signal detection circuit 40 as an external signal. Based on this external signal thus received, the external signal detection circuit 40 recognizes whether the load 10 is in a normal operating state or in a standby state. When the load 10 is found to operate in a normal operating state, the external signal detection circuit 40 outputs a high level selection signal to the switch circuits 37 and 38. On the other hand, when the load 10 is found to operate in a standby state, the external signal detection circuit 40 outputs a low level selection signal to the switch circuits 37 and 38.

As a result, when the load 10 operates in a normal operating state, that is, when the magnitude of the output current of the power supply device 1*h* is relatively large, the output voltage of the voltage supply circuit 3*c* is fed to the constant voltage circuit 31 via the common terminal 37*c* and the first terminal 37*a*, and the collector of the output transistor 2 is connected to the output terminal 12 via the first terminal 38*a* and the common terminal 38*c*. This makes the power supply device 1*h* operate in a manner similar to the power supply device 1*c* of FIG. 4. That is, the base current of the output transistor 2 is controlled so that a voltage (a feedback voltage) at a node at which voltage dividing resistances 7 and 8 are connected together is made equal to the reference voltage Vref, and the output voltage Vout outputted from the output terminal 12 is kept at a constant voltage. Additionally, since the voltage supply circuit 3*c* feeds a voltage to the control circuit 4*c* via the constant voltage circuit 31, it is possible to achieve reduction of electric power consumption just as in the fourth embodiment.

On the other hand, when the load 10 operates in a standby state, that is, when the magnitude of the output current of the power supply device 1*h* is relatively small, the voltage supply circuit 3*c* feeds electric power to the load 10 via the common terminal 37*c*, the second terminal 37*b*, the second terminal 38*b*, and the common terminal 38*c*. That is, when the load 10 operates in a standby state, the voltage supply circuit 3*c* feeds electric power to the load 10 and the supply of voltage to the control circuit 4*c* is interrupted, because there is no need to make the control circuit 4*c* operate to feed electric power to the load 10. As a result, when the electric power consumption of the load 10 is low (for example, when the load 10 is in a standby state), it is possible to reduce electric power consumption for driving the control circuit 4*c*, realizing energy saving.

Alternatively, the external signal indicating an operating state of the load 10 (or the selection signal outputted from the external signal detection circuit 40) may be fed to the drive circuit 30 so that, as in the case of the sixth embodiment, the ratio (the duty ratio) of the on-period of the switching elements S1 and S3 to the sum of the on and off periods varies depending on the operating state of the load 10.

All embodiments described above, whenever applicable, can be combined with any other embodiments. The embodiments described above deal with cases where the overheating protection circuit 18 and the overcurrent protection circuit 19 are provided in the control circuit 4*b* or the control circuit 4*c* (see FIGS. 3 to 9); in practice, however, the overheating protection circuit 18 and/or the overcurrent protection circuit 19 may be provided outside the control circuit 4*b* or the control circuit 4*c*.

Since the present invention can reduce electric power consumed in a power supply device, it is suitable for electrical apparatuses of any type. In particular, the present invention is suitable for a portable apparatus, for example, that uses a battery as a drive voltage source, such as a cellular phone, a portable computer, or a music player.

What is claimed is:

1. A direct-current stabilized power supply device comprising:

an output element that receives an input voltage from outside;

a control circuit that controls the output element so that an output voltage of the direct-current stabilized power supply device is stabilized; and a voltage supply circuit that steps down the input voltage and outputs the voltage thus obtained as a voltage for driving the control circuit, wherein the voltage supply circuit is built as a charge pump circuit that steps down the input voltage and then outputs the voltage thus obtained, wherein the direct-current stabilized power supply device further comprises an output current detection circuit that detects a magnitude of an output current of the direct-current stabilized power supply device, wherein the voltage supply circuit varies an amount of suppliable current of the charge pump circuit depending on the detected magnitude of the output current.

2. A direct-current stabilized power supply device comprising:

an output element that receives an input voltage from outside;

a control circuit that controls the output element so that an output voltage of the direct-current stabilized power supply device is stabilized; and a voltage supply circuit that steps down the input voltage and outputs the voltage thus obtained as a voltage for driving the control circuit, wherein the voltage supply circuit is built as a charge pump circuit that steps down the input voltage and then outputs the voltage thus obtained, wherein the output element is a bipolar transistor, wherein the direct-current stabilized power supply device further comprises a base current detection circuit that detects a magnitude of a base current of the bipolar transistor, and wherein the voltage supply circuit varies an amount of suppliable current of the charge pump circuit depending on the detected magnitude of the base current.

3. A direct-current stabilized power supply device comprising:

an output element that receives an input voltage from outside;

a control circuit that controls the output element so that an output voltage of the direct-current stabilized power supply device is stabilized; and a voltage supply circuit that steps down the input voltage and outputs the voltage thus obtained as a voltage for driving the control circuit, wherein the voltage supply circuit is built as a charge pump circuit that steps down the input vo1tage and then outputs the voltage thus obtained, wherein a load of the direct-current stabilized power supply device operates in a plurality of operating states of different electric power consumption, and wherein the voltage supply circuit varies an amount of suppliable current of the charge pump circuit depending on an external signal indicating an operating state of the load.

4. The direct-current stabilized power supply device of claim 1, wherein the charge pump circuit includes a plurality of switching elements connected in series, and a drive circuit that controls on/off of each of the plurality of switching elements, wherein the charge pump circuit is configured so that the amount of suppliable current of the charge pump circuit increases with an increase in a ratio of an on-period of part of the plurality of switching elements to a sum of on and off periods, and wherein the drive circuit varies the amount of suppliable current of the charge pump circuit by varying the ratio of the on-period of the part of the plurality of switching elements to the sum of the on and off periods.

5. The direct-current stabilized power supply device of claim 2, wherein the charge pump circuit includes plurality of switching elements connected in series, and a drive circuit that controls on/off of each of the plurality of switching elements, wherein the charge pump circuit is configured so that the amount of suppliable current of the charge pump circuit increases with an increase in a ratio of an on-period of part of the plurality of switching elements to a sum of on and off periods, and wherein the drive circuit varies the amount of suppliable current of the charge pump circuit by varying the ratio of the on-period of the part of the plurality of switching elements to the sum of the on and off periods.

6. The direct-current stabilized power supply device of claim 3, wherein the charge pump circuit includes a plurality of switching elements connected in series, and a drive circuit that controls on/off of each of the plurality of switching elements, wherein the charge pump circuit is configured so that the amount of suppliable current of the charge pump circuit increases with an increase in a ratio of an on-period of part of the plurality of switching elements to a sum of on and off periods, and wherein the drive circuit varies the amount of suppliable current of the charge pump circuit by varying the ratio of the on-period of the part of the plurality of switching elements to the sum of the on and off periods.

7. The direct-current stabilized power supply device of claim 1, wherein, when the detected magnitude of the output current is found to be equal to or smaller than a predetermined first threshold value, the voltage supply circuit feeds the voltage obtained by stepping down the input voltage to a load of the direct-current stabilized power supply device, and supply of voltage from the voltage supply circuit to the control circuit is interrupted.

8. The direct-current stabilized power supply device of claim 2, wherein, when the detected magnitude of the base current is found to be equal to or smaller than a predetermined second threshold value, the voltage supply circuit feeds the voltage obtained by stepping down the input voltage to a load of the direct-current stabilized power supply device, and supply of voltage from the voltage supply circuit to the control circuit is interrupted.

9. The direct-current stabilized power supply device of claim 3, wherein the operating states of the load of the direct-current stabilized power supply device include a first operating state and a second operating state in which electric power consumption is lower than that required in the first operating state, and wherein, when the external signal indicates the second operating state, the voltage supply circuit feeds the voltage obtained by stepping down the input voltage to the load of the direct-current stabilized power supply device, and supply of voltage from the voltage supply circuit to the control circuit is interrupted.

10. The direct-current stabilized power supply device of claim 1, wherein the direct-current stabilized power supply device is a chopper-type direct-current stabilized power supply device.

* * * * *